United States Patent [19]

Doherty et al.

[11] Patent Number: 4,589,484

[45] Date of Patent: May 20, 1986

[54] DEPLOYMENT SYSTEM

[75] Inventors: Brian J. Doherty, Marblehead; Andrew C. Harvey, Waltham, both of Mass.

[73] Assignee: Foster-Miller, Inc., Waltham, Mass.

[21] Appl. No.: 659,633

[22] Filed: Oct. 11, 1984

[51] Int. Cl.[4] ..... E21B 33/127

[52] U.S. Cl. ..... 166/179; 166/187

[58] Field of Search ..... 166/179, 187, 317; 277/34, 34.6

[56] References Cited

U.S. PATENT DOCUMENTS

| | | | |
|---|---|---|---|
| 2,192,805 | 3/1940 | Seamark | 255/1 |
| 2,237,709 | 4/1941 | Lowe | 137/139 |
| 2,529,744 | 11/1950 | Schweitzer | 286/16 |
| 2,854,081 | 9/1958 | Kriegel | 166/188 |
| 2,874,783 | 2/1959 | Haines | 166/212 |
| 3,011,555 | 12/1961 | Clark | 166/122 |
| 3,171,492 | 3/1965 | Cochran | 166/187 |
| 3,384,179 | 5/1968 | Haines | 166/212 |
| 3,416,607 | 12/1968 | Anastasin et al. | 166/187 |
| 3,427,651 | 2/1969 | Bielstein et al. | 166/187 |
| 4,260,164 | 4/1981 | Baker et al. | 166/187 |
| 4,302,018 | 11/1981 | Harvey et al. | 277/27 |
| 4,458,752 | 7/1984 | Brandell | 166/187 |

FOREIGN PATENT DOCUMENTS

| | | | |
|---|---|---|---|
| 439588 | 3/1975 | U.S.S.R. | 166/187 |

*Primary Examiner*—Stephen J. Novosad
*Assistant Examiner*—William P. Neuder

[57] ABSTRACT

A deployment system for use in an oil well system or the like that comprises a body for disposition in an elongated tubular casing that carries deployable apparatus for radial expansion into engagement with surfaces of the casing. A first chamber in the body contains incompressible fluid, and a second chamber in the body contains pressurized compressible fluid. A first passage interconnects the first chamber and the deployable apparatus, a second passage interconnects the first and second chambers, and differential pressure responsive means that controls the second passage has a first condition in which the second passage is closed and a second condition in which the second passage is open, the differential pressure responsive means being adapted to shift from the first condition to the second condition when the pressure in the first chamber exceeds the pressure in the second chamber by a predetermined amount.

19 Claims, 6 Drawing Figures

DEPLOYMENT SYSTEM

This invention relates to technology for subterranean installations such as oil recovery systems and the like, and more particularly to deployment apparatus for such installations.

In oil recovery enhancement, and in wells used in geothermal production, a packer type seal arrangement is frequently used to seal the casing under conditions of elevated temperature, high pressure and corrosive environment. A packer with a metal seal suitable for use in such environments is described in Harvey et al., U.S. Pat. No. 4,302,018. The packer disclosed in that patent includes metal ring structure disposed within an annular recess in an elongated tubular casing. Hydraulic fluid is flowed from the surface through a hydraulic line in the tubing string to apply pressure to the inner peripheral surface of the metal ring to deploy the seal structure by expanding the ring structure radially outward to seat its outer peripheral surface in annular sealing engagement with the opposed surface of the well casing. Deployment mechanisms that do not require such hydraulic lines are desirable.

In accordance with the invention, there is provided a deployment system for use in an oil well system or the like that comprises a body for disposition in an elongated tubular casing, and that carries deployable apparatus for expansion into engagement with surfaces of the casing. A first chamber in the body contains incompressible fluid, and a second chamber in the body contains pressurized compressible fluid. The system has a deployment mode during which the chambers are isolated from one another while force is being applied by the incompressible fluid in the first chamber to radially expand the deployable apparatus, and a maintenance mode during which the chambers are interconnected to apply the pressure of the compressible fluid in the second chamber to the deployable apparatus to maintain a radially expanded condition of the deployable apparatus, during cool down sequences, for example. The supply hydraulic fluid for seal (or other device) deployment is carried by the system body, rather than being flowed from the ground surface through a conduit that extends through the casing to the packer as in the arrangements disclosed in the above-mentioned Harvey patent.

In preferred embodiments, the pressure applied to the deployable apparatus during the deployment mode is at least about ten thousand pounds per square inch and the pressure applied to the deployable apparatus during the maintenance mode is at least about one thousand pounds per square inch; and the deployable apparatus is prepressurized (before deployment) to a pressure of at least about one thousand pounds per square inch.

In particular embodiments, the system is in a packer that includes a body member with a deployable metal seal member, the seal member having an outer surface for sealing engagement with the casing wall. Within the packer body is differential pressure structure. Hydraulic pressure from the first chamber expands the metal seal. After the metal seal has been expanded into sealing engagement with the casing wall (at a pressure of about 15,000 psi in a particular embodiment), differential pressure structure opens when the pressure in the first chamber is at least about 1,000 psi greater than the pressure in the second chamber to limit the pressure applied to the deployed seal. The compressible fluid pressure in the second chamber acts to apply a pressure somewhat lower than the deployment pressure on the seal so that the sealing pressure is maintained during thermal cycling, for example.

In particular embodiments, the packer body is an elongated tubular casing, the metal seal is a ring disposed entirely within an annular recess in the casing, and the two chambers are axially aligned. In one embodiment, a first differential pressure check valve arrangement is disposed between the two chambers and a second check valve arrangement is disposed between the second chamber and the annular seal recess; while in another embodiment the differential pressure structure includes a rupture disc type of device. In a thermally actuated deployment embodiment, hydraulic fluid is prepressurized in the first chamber and air is prepressurized in the second chamber; while in a mechanically actuated deployment embodiment, the deployable seal is prepressurized (at the second chamber pressure) and a piston arrangement is operated mechanically by the tubing string to apply deployment pressure to the seal member. Those embodiments may include means to release seal pressure to facilitate withdrawal of the tubing string.

The deployment system of the invention provides reliable deployment of a durable and conformable seal (or other device) in an effective manner and is particularly useful in subterranean environments where the deployed apparatus is subjected to thermal cycling.

Other features and advantages of the invention will be seen as the following description of particular embodiments progresses, in conjunction with the drawings, in which.

DESCRIPTION OF PARTICULAR EMBODIMENTS

Figure 1:
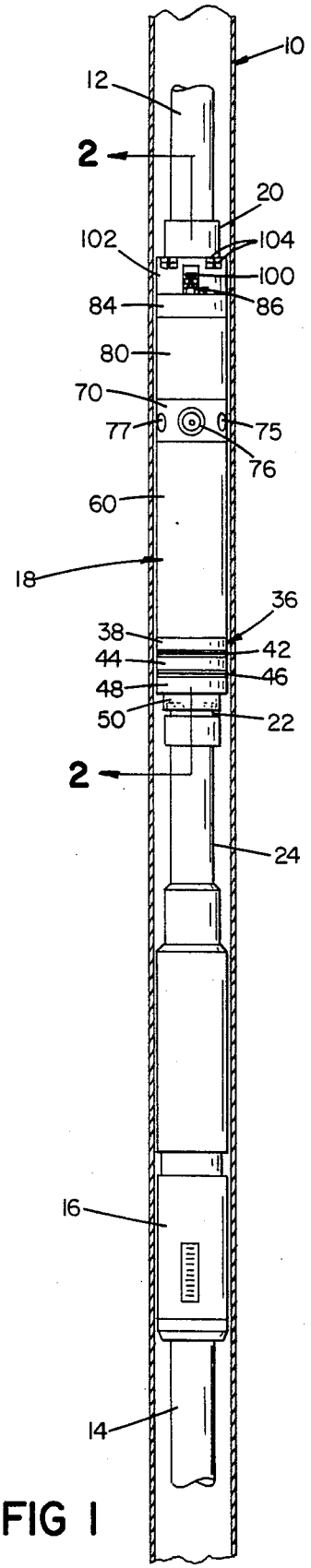
FIG. 1 is a diagrammatic illustration of thermally actuated deployment apparatus in accordance with the invention.

Shown in FIG. 1 is casing 10 that extends downwardly from the ground surface to an oil reservoir or other subsurface geologic formation. Disposed within casing 10 is an integrated flow system that includes tubing sections 12, 14 (and other appropriate hardware not shown), tubing anchor 16 (such as a Brown Model TA tubing anchor), packer unit 18, and tubing section 24 that interconnects units 16 and 18. Packer unit 18 has an upper coupling portion 20 that is threadedly connected to tubing section 12 and a lower coupling portion 22 that is threadedly connected to tubing section 24.

Figure 2:
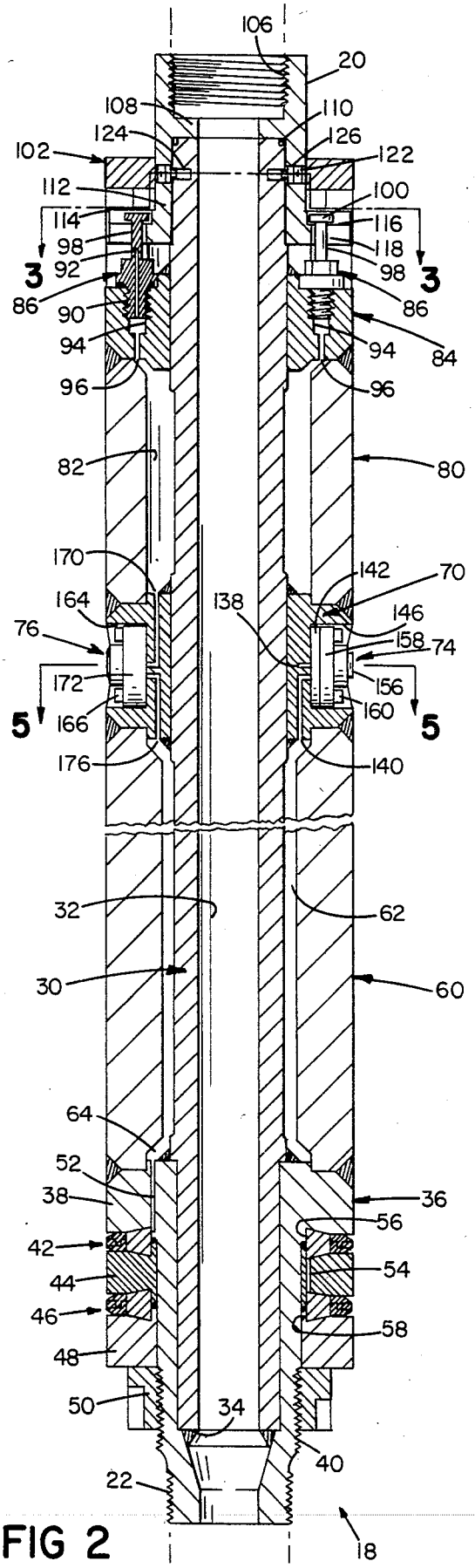
FIG. 2 is a sectional view taken along the line 2—2 of FIG. 1 of the deployment apparatus shown in FIG. 1.

Further details of the packer unit 18 may be seen with reference to FIG. 2. That packer unit includes tube 30 of heat treated steel that is about fifty inches in length and defines a through passage 32 that is about 1½ inches in diameter. The lower end of sleeve 30 is received in member 36 that has an annular flange 38 (about six inches in outer diameter) with a lower extension in which threaded coupling 24 and an intermediate threaded section 40 are formed. Seated against flange 38 is a series of elements including deployable upper seal ring assembly 42, intermediate die member 44, deployable lower seal ring assembly 46, and a lower die member 48. This series of seal assemblies and die members are secured on member 36 by nut 50. Seal ring assemblies 42, 46 are of the type disclosed in the above mentioned Harvey Pat. No. 4,302,018 (the disclosure of which is incorporated herein by reference). A passage 52 extends through flange 38 from its upper surface to its lower surface and communicates with the inner surface of upper seal ring assembly 42. A similar passage 54 extends through die ring 44 and provides fluid communication between the inner surface of upper seal ring assembly 42 and the inner surface of lower seal ring assembly 46.

Welded to the upper end of flange 38 of member 36 in fluid tight relation is sleeve 60 that has a length of about seventeen inches and defines, with tube 30, pressure chamber 62 that is filled with hydraulic fluid (an incompressible fluid). The lower end of chamber 62 is in communication with passage 52 through transition passage 64.

The upper end of chamber 62 is sealed by intermediate housing member 70 which is seated on and welded to the upper end of sleeve 60. Housing 70, as indicated in FIG. 5, carries two valve assemblies 72, 74, and a rupture disc assembly 76, port 75 communicating with valve assembly 72 and port 77 communicating with valve assembly 74.

Seated on and welded in fluid tight relation to the upper surface of housing member 70 is a second sleeve 80 that has an axial length of about six inches and defines, with tube 30, pressure chamber 82 that contains a pressurized compressible fluid such as air. Seated on and welded to the upper end of sleeve 80 (and defining the upper wall of chamber 82) is disc member 84 that carries two vent assemblies 86. Each vent assembly 86 has a body 88 and a threaded shank 90 which is received in bore 94 in disc 84 with its body 88 seated in sealing relation on the upper surface of disc 84. The threaded bore 94 in which vent member 86 is received has a passage 96 extending from the bottom of bore 94 to chamber 82. A vent passage 92 extends through shank 90 and body 88 and terminates in stub 98 that has an enlarged head 100.

Figure 3:
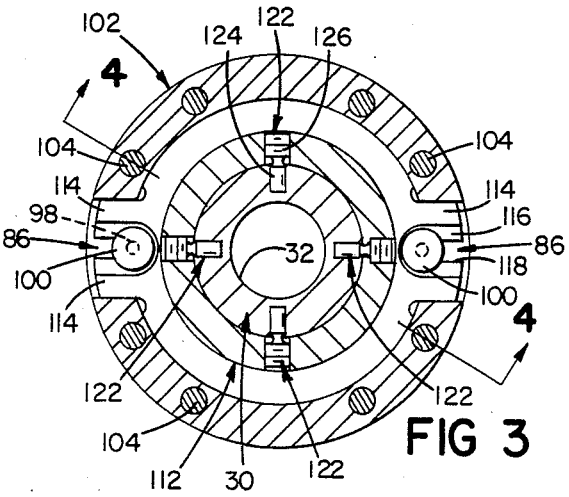
FIG. 3 is a sectional view taken along the line 3—3 of FIG. 2.
Figure 4:
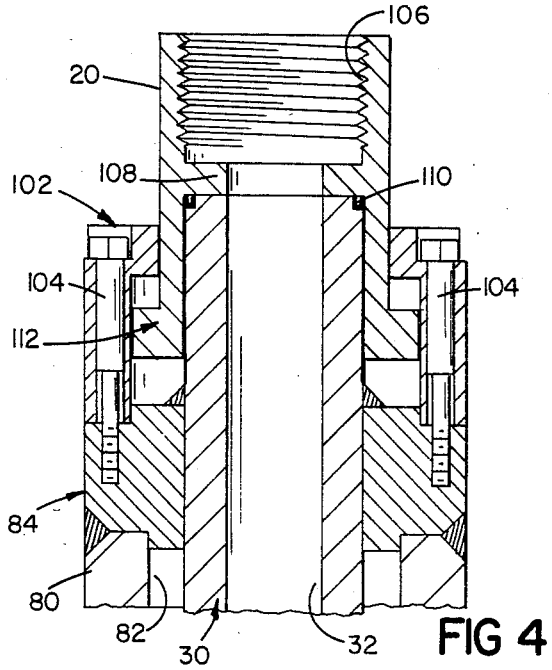
FIG. 4 is a sectional view taken along the line 4—4 of FIG. 3.

End cap 102 is secured on disc 84 by bolts 104 (FIG. 4), and houses the lower end of coupling 20. Coupling 20 has an internally threaded section 106 that receives tube 12, an inwardly extending flange 108 that is seated on the upper end of tube 30 and sealed by seal element 110; a lower sleeve portion 112 in which the upper end of tube 30 is received and from which extends radially outwardly two tab flanges 114, each of which has a recessed section 116 in which the head 100 of a vent member 86 is received with the stud portion 98 extending through the slot 118 in tab 114 as indicated in FIGS. 2 and 3. Coupling member 20 is secured to tube 30 by four shear pins 122, each of which has a head portion 124 which is received in a bore in tube 30 and a body portion 126 which is threadedly secured in coupling 20 to interconnect coupling 20 and tube 30.

Figure 5:
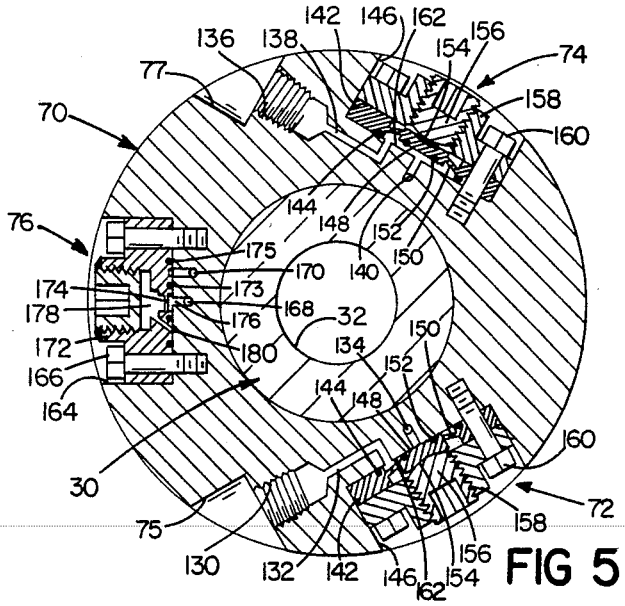
FIG. 5 is a sectional view taken along the line 5—5 of FIG. 2.

Further details of the valve assemblies 72 and 74, and rupture disc assembly 76 carried by housing member 70 may be seen with reference to FIG. 5. Valve assembly 72 controls a flow path between port 75 (via threaded coupling 130 and passage 132) and passage 134 which extends upwardly and communicates with the upper pressurized chamber 82. Valve assembly 74 similarly controls fluid flow from port 77 (via threaded coupling 136 and passage 138) and passage 140 which communicates with lower pressure chamber 62. Each valve assembly 72, 74 includes a valve support disc 142 that carries seal 144 and is seated on the base of cylindrical cavity 146, and has a valve member 148 that is connected to support disc 142 by flex web 150. Valve member 148 carries seal 152 in its lower surface and has a radiused depression 154 in its upper surface which mates with the corresponding domed surface of valve control member 156. Member 156 is threadedly carried by clamp disc 158 that seats valve disc 142 in cavity 146 and is secured by bolts 160. Valve operator 156 is movable between a released position in which the valve member 148 is open (spaced from the seat 162 of valve cavity 146—the position of valve 74 shown in FIG. 5) to provide a flow path, in the case of valve assembly 72 from port 75 to chamber 82, and in the case of valve assembly 74 from port 77 to chamber 62; and a closed position in which valve member 148 is firmly seated on the base 162 of cavity 146 to seal that passage (the position of valve 72 shown in FIG. 5).

Rupture disc assembly 76 is secured in cavity 164 by bolts 166. Extending from the base of cavity 164 is passage 168 that extends downwardly to chamber 62 and passage 170 that extends upwardly to chamber 82. Body 172 of assembly 76 is of configuration similar to discs 142 and 158. Seal rings 173, 175 carried by body 172 are seated on the base of cavity 164. Formed in body 162 is rupture disc 174 that separates external cavity 176 (that is in communication with lower chamber 62 via passage 168) and internal cavity region 178 (that is in communication with upper chamber 82 via passage 180 that extends from cavity 178 to the region between seal rings 172, 173 and passage 170). Rupture disc 174 in this embodiment breaks at a differential pressure of 10,000 psi; i.e., when hydraulic pressure in chamber 62 is 10,000 psi above air pressure in chamber 82.

In preparing packer 18 for use, chamber 62 is charged with hydraulic fluid through passage 140, valve 74 and a fitting attached to coupling 136 at port 77 to a pressure of about 5,000 psi. Concurrently, chamber 82 is charged with air through passage 134, valve 72 and a fitting attached to coupling 130 at port 72 to a pressure of about 7,000 psi. Valves 72 and 74 are then closed by seating valve members 148 on the cavity surfaces 162 with operator members 156.

The tubing string, with the charged packer assembly 18 and anchor 16, is run into casing 10 and locked in the desired position by anchor 16 that is hydraulically or mechanically set in conventional manner. Steam is then flowed through the tubing string to the subterranean geologic formation to be treated. As the steam flows through passage 32, the temperature of tube 30 and the temperature of the hydraulic fluid in chamber 62 increases. As the pressurized hydraulic fluid expands, the pressure that acts through passages 52 and 54 on the inner surfaces of the seal ring assemblies 42 and 46 increases. The composite seal ring assemblies 42, 46 expand radially outwardly with each ring assembly being deformed and forced through the lips of its die in an expansion and extrusion action creating an enlarged ring, the outer surface of which seats against the inner surface of casing 10. In this embodiment, seal ring assemblies 42, 46 require pressures in excess of 12,000 psi (but less than 17,000 psi) for expansion. After ring assemblies 42, 46 are sealingly seated against casing 10, continued thermal expansion of the incompressible hydraulic fluid causes the pressure in chamber 62 to increase until the pressure differential across rupture disc 174 is sufficient to break that disc, interconnecting passages 168 and 170 (and chambers 62 and 82). The overall pressure of the interconnected chambers is then reduced to approximately the pressure of the compressible fluid in chamber 82 (about 7,000 psi) which pressure maintains the seal ring assemblies 42, 46 firmly seated against the inner surface of casing 10 substantially independent of the packer temperature so that their sealing actions are not impaired due to thermal cycling of the packer assembly 18.

In retrieving the tubing string, the tubing anchor assembly 16 is released in conventional manner, and the sealing action of packer assembly 18 is released by upward pull on tubing string 12 with force sufficient to break shear pins 122 and allow coupling 20 to slide upwardly against end cap 102. That upward movement of coupling flanges 114 breaks studs 98 so that chamber 82 is vented through passages 92 and 96, and the pressure on seal assemblies 42, 46 drops, releasing the packer assembly 18 for retrieval.

Figure 6:
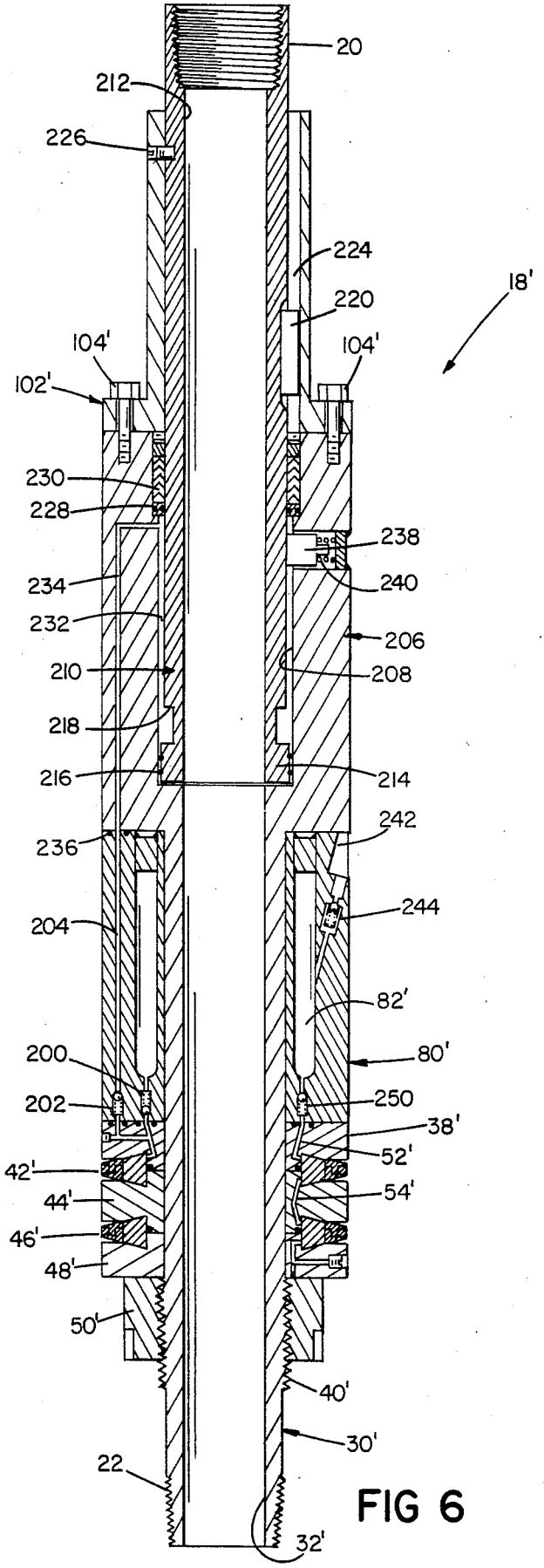
FIG. 6 is a sectional view, similar to FIG. 2, of mechanically actuated deployment apparatus in accordance with the invention.

Another packer seal deployment system is shown in FIG. 6. The system is similar to the deployment system shown in FIG. 2 except that it incorporates mechanically actuated seal deployment apparatus. That system includes a similar central tube 30' that has a threaded coupling portion 22' at its lower end and an intermediate threaded portion 40' which receives nut 50' to secure seal assemblies 42', 46' together with cooperating associated die members 38', 44' and 48' against the lower surface of annular sleeve member 80' which is received on tube 30' and in which a chamber 82' is defined. Passages 52' and 54' provide communication to the rear surfaces of seal assemblies 42' and 46' similar to the seal and die arrangements of the deployment apparatus shown in FIG. 2. A differential pressure responsive device (check valve 200 that opens when the pressure differential across the valve exceeds a suitable value, for example fifteen thousand pounds per square inch) connects passage 52' to chamber 82', and passage 52' is connected to passage 204 that extends through sleeve 60' by check valve 202 (that opens when the pressure in passage 204 exceeds the pressure in passage 52').

The upper end of tube 30' has an enlarged portion 206 (an outer diameter of about six inches) with a cylindrical bore 208 in which piston 210 is disposed. Piston 210 defines a through passage 212 that is aligned with and is a continuation of passage 32' in member 30'; has coupling 20' at its upper end; piston head portion 214 at its lower end which carries piston ring seal members 216 in sealing engagement with the surface of bore 208; latch recess 218 adjacent piston head 214; and key 220 in its outer wall at a location intermediate piston head 214 and coupling 20'. Cap member 102' is secured to member 30' with bolts 104' and includes a tubular upwardly extending extension 222 with keyway 224 in which key 220 slides. Shear pin 226 locks piston 210 to cap 102'. Seal ring 228 and chevron seals 230 at the upper end of portion 206 of member 30' seal the upper end of the annular chamber 232 defined between cylinder wall 208 and piston 210. Passage 234 extends from chamber 232 at a point just below seal ring 228 downwardly to a communicating interface with passage 204 that is sealed by seal 236. Latch 238 in portion 206 is biased by spring 240 against the outer surface of piston 210.

In preparation for packer use, after chamber 232 (and passages 234, 204, 248, 54' and 52') are filled with incompressible hydraulic fluid, chamber 82' is partially filled with the hydraulic fluid and then is pressurized with air or other appropriate compressible fluid through port 242 and check valve 244 in manner similar to the pressurizing of chamber 82 of the packer unit shown in FIG. 2, to prepressurize seal ring assemblies 42', 46' with a suitable pressure, for example two thousand pounds per square inch, through check valve 250.

The packer assembly 18' is then attached to the tubing string with a tubing anchor 16 and/or other appropriate device(s), run into the casing 10 and locked in position with the tubing anchor set in conventional manner. Upward pull on the tubing string 12 then snaps shear pin 226, allowing piston head 214 to slide upwardly in chamber 208. That upward movement of piston head 214 forces hydraulic fluid through passages 234 and 204 and check valve 202 to passage 52' and applies pressure on the inner surfaces of the seal ring assemblies 42', 46', expanding them through the dies in expansion and extrusion actions and setting the seals against the walls of the casing 10. When the hydraulic pressure reaches a predetermined value in excess of the seal deployment pressure (about 17,000 psi in this embodiment), check valve 200 opens (as a function of the pressure in chamber 82' and the setting of that valve), placing the pressurized seal deployment passage 52' in communication with chamber 82' and thus limiting that pressure. Check valve 250 opens whenever the pressure in chamber 82' exceeds the pressure on the inner surface of the seal ring assemblies 42'. This controls the minimum pressure to which the seal rings are subjected and serves to maintain pressure during cool down thermal transients. A pressure relief arrangement may be employed to release pressure in chamber 82' and on the seals 42', 46' when it is desired to retrieve packer assembly 18'.

While particular embodiments of the invention have been shown and described, various modifications will be apparent to those skilled in the art, therefore it is not intended that the invention be limited to the disclosed embodiments or to details thereof and departures may be made therefrom within the spirit and scope of the invention.

What is claimed is:

1. A deployment system for use in an oil well system or the like comprising a body for disposition in an elongated tubular casing, a first chamber in said body containing an incompressible fluid, and a second chamber in said body containing pressurized compressible fluid, said system having means for isolating said chambers from one another during a deployment mode while force is being applied by the imcompressible fluid in said first chamber to radially expand said deployable apparatus, and means for interconnecting said chambers during a maintenance mode to apply the pressure of the compressible fluid in said second chamber to said deployable apparatus to maintain a radially expanded condition of said deployable apparatus.

2. The system of claim 1 wherein said interconnection means includes differential pressure responsive means for connecting said second chamber to said deployable apparatus during said maintenance mode, said differential pressure responsive means being adapted to isolate said second chamber from said deployable apparatus during said deployment mode.

3. The system of claim 1 wherein said interconnection means includes differential pressure responsive means for interconnecting said chambers during said maintenance mode, said differential pressure responsive means being operative to not interconnect said two chambers until the pressure in said first chamber is at least about one thousand pounds per square inch greater than the pressure in said second chamber.

4. The system of claim 3 wherein said differential pressure responsive means includes a check valve arrangement disposed between said two chambers.

5. The system of claim 3 wherein said differential pressure responsive means includes a rupture disc type of arrangement disposed between said two chambers.

6. The system of claim 1 and further including a piston arrangement coupled to said first chamber for applying pressure to said incompressible fluid.

7. The system of claim 6 wherein said piston arrangement is operated mechanically by tubing string structure to apply deployment pressure to said deployable apparatus.

8. The system of claim 7 wherein said deployable apparatus is in a packer that includes a body member with an annular recess and said deployable apparatus includes a deployable metal ring member disposed in said annular recess, said ring member having an outer surface for sealing engagement with the casing wall.

9. The system of claim 8 and further including means to release chamber pressure to facilitate withdrawal of the tubing string.

10. The system of claim 1 wherein the pressure applied to said deployable apparatus during said deployment mode is at least about ten thousand pounds per square inch and the pressure applied to said deployable apparatus during said maintenance mode is at least about one thousand pounds per square inch.

11. The system of claim 10 wherein said deployable system is in a packer and said deployable apparatus includes deployable metal ring structure, said ring structure having an outer surface for sealing engagement with the casing wall.

12. The system of claim 11 wherein said two chambers within said packer body are axially aligned.

13. The system of claim 10 wherein said second chamber is prepressurized to a pressure of at least about one thousand pounds per square inch.

14. The system of claim 13 and further including means to release the pressure applied to said deployable apparatus to facilitate withdrawal of said packer.

15. The system of claim 14 wherein the hydraulic fluid stored in said first chamber is prepressurized to a pressure of at least about five thousand pounds per square inch.

16. The system of claim 15 wherein said interconnection means includes differential pressure responsive means for connecting said second chamber to said deployable apparatus during said maintenance mode, said differential pressure responsive means being adapted to isolate said second chamber from said deployable apparatus during said deployment mode.

17. The system of claim 16 wherein said differential pressure responsive means includes a check valve arrangement disposed between said two chambers.

18. The system of claim 16 wherein said differential pressure responsive means includes a rupture disc type of arrangement disposed between said two chambers.

19. The system of claim 14 and further including a piston arrangement coupled to said first chamber for applying pressure to said incompressible fluid, first differential pressure responsive means for isolating said second chamber from said deployable apparatus during said deployment mode and for connecting said second chamber to said deployable apparatus during said maintenance mode, and second differential pressure responsive means for interconnecting said chambers during said maintenance mode, said second differential pressure responsive means being operative to not interconnect said two chambers until the pressure in said first chamber is at least about one thousand pounds per square inch greater than the pressure in said second chamber, said piston arrangement being operated mechanically by tubing string structure to apply deployment pressure to said deployable apparatus.

* * * * *